United States Patent [19]

Despot et al.

[11] Patent Number: 4,495,863

[45] Date of Patent: Jan. 29, 1985

[54] ARRANGEMENT FOR PREVENTION OF ROLLER MARKS ON ROLLER UNITS IN A PRINTING PRESS

[75] Inventors: Janko Despot; Paul Abendroth, both of Offenbach am Main, Fed. Rep. of Germany

[73] Assignee: M.A.N.-Roland Druckmaschinen Aktiengesellschaft, Fed. Rep. of Germany

[21] Appl. No.: 472,592

[22] Filed: Mar. 7, 1983

[30] Foreign Application Priority Data

Mar. 26, 1982 [DE] Fed. Rep. of Germany ..... 3211154

[51] Int. Cl.[3] ..... B41F 31/30

[52] U.S. Cl. ..... 101/350; 101/148

[58] Field of Search ..... 101/148, 349, 350, 206, 101/207

[56] References Cited

U.S. PATENT DOCUMENTS

| | | | |
|---|---|---|---|
| 287,383 | 10/1883 | Kendall et al. | 101/206 X |
| 423,394 | 3/1890 | Saxton | 101/350 X |
| 444,231 | 1/1891 | Brooks | 101/207 |
| 1,040,268 | 10/1912 | Brooks et al. | 101/207 X |
| 3,970,186 | 10/1975 | D'Amato et al. | 101/350 X |

FOREIGN PATENT DOCUMENTS

| | | | |
|---|---|---|---|
| 286057 | 7/1915 | Fed. Rep. of Germany | 101/148 |
| 2040228 | 8/1980 | United Kingdom | 101/148 |

*Primary Examiner*—Edgar S. Burr
*Assistant Examiner*—John A. Weresh
*Attorney, Agent, or Firm*—Leydig, Voit, Osann, Mayer & Holt, Ltd.

[57] ABSTRACT

In a rotary printing machine, an arrangement for mounting an applicator roller and a preceding roller in a fluid feed stream journals the applicator roller and the preceding roller to the printing machine frame with substantial bearing play, and spring loads the applicator roller against the bearing surface away from the plate cylinder.

On passing through the cylinder gap the applicator rollers of inking, damping or varnishing units in sheet-fed offset presses are jolted both at the start and end of the gap. The resulting different flattening of the soft applicator rollers causes roller marks, which should be avoided. For this purpose the applicator roller and the preceding roller are braced against each other by springs, so that their bearing play is eliminated and the distance between shafts is constant. This condition is also maintained on passage through the gap. Conveyance of liquid between applicator rollers and the preceding rollers is thus constant.

2 Claims, 2 Drawing Figures

ARRANGEMENT FOR PREVENTION OF ROLLER MARKS ON ROLLER UNITS IN A PRINTING PRESS

BACKGROUND OF THE INVENTION

1. Field of the Invention

The present invention relates to applicator roller systems which apply fluid to a plate cylinder in a rotary printing machine.

2. Description of the Prior Art

It is already known that in roller units on sheet-fed printing presses the applicator rollers must be placed with a specific pressure against the plate cylinder for accurate transfer of ink, damping solution or varnish. At the same time the applicator rollers must also be adjustable in relation to the other rollers in contact with them in the roller unit.

SUMMARY OF THE INVENTION

As a result of the cylinder gap the contact pressure between the applicator rollers and plate cylinder causes a double load change during a plate cylinder revolution.

This load change and the bearing play also cause a change in the distance between the shafts and thus also in the contact pressure between the applicator roller and the roller interacting with it, which is usually designed as a distributor roller. This means that the contact area of both rollers varies cyclically.

It has been found that the load change occurring at the leading edge is particularly disadvantageous, because the jolt caused by the load change produces a larger contact area as a result of higher pressure and thus reduces the supply of ink, damping solution or varnish, which manifests itself in the form of roller marks in the printing result. This jolt is intensified as the machine speed increases, so that the roller mark takes effect particularly at high machine speeds.

However, this disadvantage cannot be offset merely by increasing the contact pressure between the distributor and applicator rollers, because this would result in flattening of the applicator roller at the point of contact between the two rollers during machine stoppages.

The object of the invention is to provide a mounting for the rollers in a roller unit of a printing press, in which a jolt acting on the applicator roller does not cause an increase in the pressure between the applicator roller and the roller interacting with it.

This problem is solved by journaling the applicator roller and the preceding roller in the fluid feed stream to the printing machine with substantial bearing play, spring loading the applicator roller against the bearing surface away from the plate cylinder, and spring loading the preceding roller into contact with the applicator roller.

The advantage of an arrangement of this type is that the fixed distance between the shafts of the two rollers prevents an increase in the pressure. It is also advantageous that the jolt can be conducted into the machine frame or to another point in the roller unit where it can no longer affect the printing result.

BRIEF DESCRIPTION OF THE DRAWINGS

The invention is explained in more detail below with reference to the drawings, in which.

DESCRIPTION OF THE PREFERRED EMBODIMENT

Figure 1:
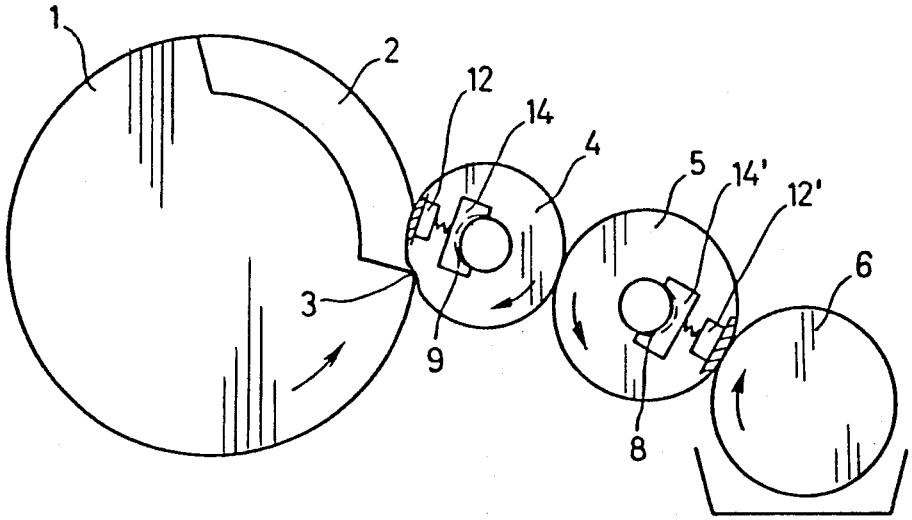
FIG. 1 shows in schematic form a plate cylinder and a roller unit.
Figure 2:
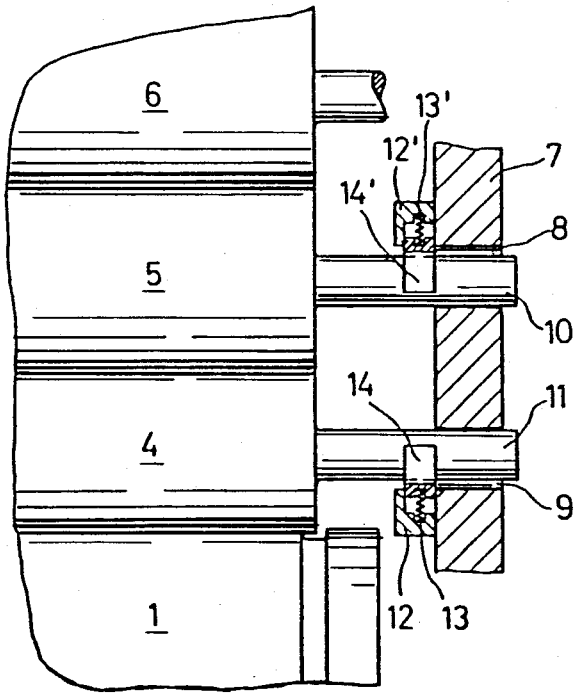
FIG. 2 is a section of the roller unit with a schematic representation of the devices for making the mounting play-free. It is not intended to limit the invention to the specific embodiment shown in the drawings, but, on the contrary, the intention is to cover all modifications, equivalents, and alternatives falling within the spirit and scope of the invention as defined by the appended claims.

The plate cylinder 1 has a gap 2 incorporating already known means of securing the printing plate, which are not explained in more detail here. An applicator roller is placed against the plate cylinder 1 and is adjustable in relation to the latter and a distributor roller 5. The distributor roller 5 interacts with a further roller designed as a scoop roller 6.

The applicator roller 4 is placed with a defined contact pressure against the plate cylinder 1 for good transfer of the medium conveyed by the rollers 4, 5 and 6. Applicator rollers are usually covered by an elastic layer such as rubber or a similar material. During rotation of the plate cylinder 1 the compressive stress between the plate cylinder 1 and applicator roller 4 suddenly collapses as a result of the cylinder gap 2 and is restored just as suddenly when the leading edge 3 contacts the applicator roller 4. The resulting jolt must now be absorbed in such a way that the compressive stress between the applicator roller 4 and distributor roller 5 does not vary.

For this purpose supports 12, in which pressure plates 14 are spring-mounted, are provided on the frame wall 7. These supports 12 and the pressure plates are arranged, so that they press on the bearing journals 10 and 11 and the applicator roller 4 and distributor roller 5 are forced against each other. The play in the bearing holes 8 and 9 is displaced in such a way that the jolt is conducted directly into the frame wall 7. The distance between the shafts of applicator roller 4 and distributor roller 5 is thus fixed accurately.

If the jolt takes effect between the distributor roller 5 and scoop roller 6, the printed image can no longer be affected, because distribution takes place between the applicator roller 4 and distributor roller 5.

What is claimed is:

1. In a rotary printing machines having a plate cylinder (1), a frame (7), and arrangement for mounting to the frame (7) an applicator roller (4) for applying fluid to the plate cylinder (1) and a preceding roller (5) in a fluid feed system (6,5,4,1) for applying fluid to the applicator roller (4), and said plate cylinder being journalled to said frame without substantial bearing play and being formed with a recessed gap (2) over a segment of its outer periphery which defines a leading plate cylinder edge (3) which cyclically engages the applicator roller (4), wherein the improvement comprises means for preventing undesirable roller marks in the fluid applied to the plate cylinder upon cyclic engagement of the leading edge of the plate cylinder with the applicator roller, said means including means mounting the applicator roller and preceding roller for movement toward and away from the plate cylinder, said means mounting consisting of journal means for each of said rollers, each of said journal means having substantial bearing play, a pressure plate (14) acting on the bearing journal (11) of the applicator roller (4) under the force of a first spring (13) to force the applicator roller journal (11) toward the bearing surface away from the plate cylinder (1), and a pressure plate (14') acting on the bearing journal (10) of the preceding roller (5) under the force of a second spring (13') to urge the preceding roller (5) into contact with the applicator roller (4) so as to prevent excessive increases in pressure between the applicator roller (4) and preceding roller (5) upon said cyclic engagement of the leading edge (3) of the plate cylinder (1) with the applicator roller.

2. The improvement as claimed in claim 1, wherein each pressure plate (14,14') is connected to a respective spring (13,13') mounted in a respective support (12,12') secured to the frame (7).

* * * * *